US010428403B2

(12) United States Patent
Hayakawa et al.

(10) Patent No.: US 10,428,403 B2
(45) Date of Patent: Oct. 1, 2019

(54) METHOD FOR MANUFACTURING GRAIN-ORIENTED ELECTRICAL STEEL SHEET

(71) Applicant: JFE STEEL CORPORATION, Chiyoda-ku, Tokyo (JP)

(72) Inventors: Yasuyuki Hayakawa, Tokyo (JP); Masayasu Ueno, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 0 days.

(21) Appl. No.: 15/528,208

(22) PCT Filed: Nov. 26, 2015

(86) PCT No.: PCT/JP2015/005879
§ 371 (c)(1),
(2) Date: May 19, 2017

(87) PCT Pub. No.: WO2016/084378
PCT Pub. Date: Jun. 2, 2016

(65) Prior Publication Data

US 2017/0321296 A1 Nov. 9, 2017

(30) Foreign Application Priority Data

Nov. 27, 2014 (JP) ..... 2014-240500

(51) Int. Cl.
*C21D 9/46* (2006.01)
*C22C 38/00* (2006.01)
(Continued)

(52) U.S. Cl.
CPC ..... *C21D 9/46* (2013.01); *B21B 3/02* (2013.01); *C21D 8/1233* (2013.01);
(Continued)

(58) Field of Classification Search
CPC ..... C21D 9/46; C21D 8/1233; C21D 8/1244; C21D 8/1255; C21D 8/1266;
(Continued)

(56) References Cited

U.S. PATENT DOCUMENTS 1,965,559 A 7/1934 Goss
3,932,234 A 1/1976 Imanaka et al.
(Continued)

FOREIGN PATENT DOCUMENTS

CN 1351186 A 5/2002
CN 102114493 A * 7/2011
(Continued)

OTHER PUBLICATIONS

Oct. 17, 2017, Extended European Search Report issued by the European Patent Office in the corresponding European Patent Application No. 15862897.4.
(Continued)

*Primary Examiner* — Keith Walker
*Assistant Examiner* — John A Hevey
(74) *Attorney, Agent, or Firm* — Kenja IP Law PC

(57) ABSTRACT

Disclosed is a method for manufacturing a grain-oriented electrical steel sheet using an inhibitor-less technique, in which cold rolling includes final cold rolling with a total cold rolling reduction being set to 85% or more and a rolling reduction per pass being set to 32% or more. The final cold rolling includes one or more passes and a final pass succeeding the one or more passes and uses work rolls having a surface roughness Ra of 0.25 μm or less in at least one of the one or more passes other than the final pass. According to this method, it is possible to stably manufacture a grain-oriented electrical steel sheet exhibiting excellent magnetic properties at low cost.

6 Claims, 4 Drawing Sheets

(51) Int. Cl.

| | |
|---|---|
| ***C22C 38/60*** | (2006.01) |
| ***H01F 1/16*** | (2006.01) |
| ***C21D 8/12*** | (2006.01) |
| ***C22C 38/02*** | (2006.01) |
| ***C22C 38/04*** | (2006.01) |
| ***B21B 3/02*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/18*** | (2006.01) |
| ***C22C 38/22*** | (2006.01) |
| ***C22C 38/34*** | (2006.01) |
| ***B21B 1/22*** | (2006.01) |

(52) U.S. Cl.
CPC ..... *C21D 8/1255* (2013.01); *C21D 8/1266* (2013.01); *C21D 8/1272* (2013.01); *C21D 8/1283* (2013.01); *C22C 38/00* (2013.01); *C22C 38/001* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/18* (2013.01); *C22C 38/22* (2013.01); *C22C 38/34* (2013.01); *C22C 38/60* (2013.01); *H01F 1/16* (2013.01); *B21B 2001/221* (2013.01); *B21B 2265/14* (2013.01); *B21B 2267/10* (2013.01); *C21D 8/1244* (2013.01); *C21D 2201/05* (2013.01)

(58) Field of Classification Search
CPC ..... C21D 8/1283; C21D 8/1272; C21D 2201/05; C22C 38/00; C22C 38/001; C22C 38/008; C22C 38/02; C22C 38/04; C22C 38/06; C22C 38/08; C22C 38/12; C22C 38/16; C22C 38/18; C22C 38/22; C22C 38/34; C22C 38/60; B21B 3/02; B21B 2001/221; B21B 2267/10; B21B 2265/14; H01F 1/16
See application file for complete search history.

(56) References Cited

U.S. PATENT DOCUMENTS

| | | | | |
|---|---|---|---|---|
| 2002/0038678 | A1* | 4/2002 | Ushigami ..... | C21D 8/1255 148/113 |
| 2015/0170812 | A1 | 6/2015 | Murakami et al. | |
| 2015/0194247 | A1 | 7/2015 | Shingaki et al. | |

FOREIGN PATENT DOCUMENTS

| | | | | |
|---|---|---|---|---|
| CN | 102114493 | A | | 7/2011 |
| CN | 103687966 | A | | 3/2014 |
| EP | 0837148 | A2 | | 4/1998 |
| EP | 1179603 | A2 | | 2/2002 |
| JP | S4015644 | B | | 7/1965 |
| JP | S5113469 | B | | 4/1976 |
| JP | S5938326 | A | | 3/1984 |
| JP | S6115919 | A | | 1/1986 |
| JP | H02175010 | A | | 7/1990 |
| JP | H06339701 | A | | 12/1994 |
| JP | H11199933 | A | | 7/1999 |
| JP | 2000129356 | A | * | 5/2000 |
| JP | 2000129356 | A | | 5/2000 |
| JP | 2001032021 | A | | 2/2001 |
| JP | 3873309 | B2 | | 1/2007 |
| JP | 4029523 | B2 | | 1/2008 |
| JP | 2009228117 | A | | 10/2009 |
| JP | 2011143440 | A | | 7/2011 |
| JP | 2012184497 | A | | 9/2012 |
| WO | 2014017590 | A1 | | 1/2014 |

OTHER PUBLICATIONS

Mar. 1, 2016, International Search Report issued in the International Patent Application No. PCT/JP2015/005879.
Feb. 14, 2018, Office Action issued by the State Intellectual Property Office in the corresponding Chinese Patent Application No. 201580064481.5 with English language Search Report.

* cited by examiner

METHOD FOR MANUFACTURING GRAIN-ORIENTED ELECTRICAL STEEL SHEET

TECHNICAL FIELD

This disclosure relates to a method that can manufacture a grain-oriented electrical steel sheet with excellent magnetic properties at low cost.

BACKGROUND

Grain-oriented electrical steel sheets are soft magnetic materials that used in iron cores for transformers, generators, and the like, and that have crystalline structures in which the <001> orientation, which is an easy magnetization axis of iron, highly accords with the rolling direction of the steel sheets. Such a crystalline structure (texture) is formed through secondary recrystallization such that coarse crystal grains with the (110)[001] orientation, or so-called Goss orientation, are caused to grow preferentially during secondary recrystallization annealing in the production of a grain-oriented electrical steel sheet.

Conventionally, such grain-oriented electrical steel sheets are manufactured by the following procedure (for example, U.S. Pat. No. 1,965,559A [PTL 1], JPS4015644B [PTL 2], and JPS5113469B [PTL 3]).

Specifically, a slab that contains about 4.5 mass % or less of Si and inhibitor components, such as MnS, MnSe, AlN, and the like is heated above 1300° C. to dissolve the inhibitor components, and then hot rolled into a hot rolled sheet. The hot rolled sheet is optionally subjected to hot band annealing. The hot rolled sheet is subjected to cold rolling either once, or twice or more with intermediate annealing performed therebetween, to obtain a cold rolled sheet having a final thickness. Then, for primary recrystallization and decarburization, the cold rolled sheet is subjected to decarburization and primary recrystallization annealing in a wet hydrogen atmosphere. Subsequently, after an annealing separator mainly composed of magnesia (MgO) being applied to a surface of the obtained steel sheet, the steel sheet is subjected to final annealing at 1200° C. for about 5 h for the purpose of secondary recrystallization and purification of the inhibitor components, to thereby obtain a product steel sheet.

CITATION LIST

Patent Literature

PTL 1: U.S. Pat. No. 1,965,559A
PTL 2: JPS4015644B
PTL 3: JPS5113469B
PTL 4: JP2000129356A
PTL 5: JP3873309B
PTL 6: JPS5938326A
PTL 7: JPH2175010A
PTL 8: JPH11199933A
PTL 9: JP2011143440A

SUMMARY

Technical Problem

As described above, in conventional methods for manufacturing grain-oriented electrical steel sheets, precipitates (inhibitor components) such as MnS, MnSe, AlN, and the like are contained in a slab, and the slab is heated at high temperatures exceeding 1300° C. to cause the inhibitor components to be dissolved as solutes. In a later stage, the inhibitor components are caused to finely precipitate as inhibitors, and the inhibitors are used to bring about secondary recrystallization.

In other words, the conventional methods for manufacturing grain-oriented electromagnetic steel sheets require slab heating at high temperatures exceeding 1300° C., and this requirement necessarily causes extremely high production costs, making it difficult to meet the increasing demands for production cost reduction.

To address this issue, JP2000129356A (PTL 4) discloses a technique (inhibitor-less technique) that can cause secondary recrystallization without inhibitor components. This technique is technically distinct from the conventional methods of manufacturing grain oriented electrical steel sheets. Specifically, contrary to the conventional methods that cause secondary recrystallization by using precipitates (inhibitors) such as MnS, AlN, MnSe and the like, this inhibitor-less technique does not use any inhibitors, but instead increases the purity of the material and controls its texture to cause secondary recrystallization.

This inhibitor-less technique does not require slab heating at high temperature or secondary recrystallization annealing at high temperature over a long time, and thus allows for manufacture of grain-oriented electrical steel sheets at low cost.

However, although the above inhibitor-less technique is advantageous in terms of production cost, this method is not necessarily favorable in terms of quality and stability of magnetic properties.

To address these issues, it could thus be helpful to provide a method for manufacturing a grain-oriented electrical steel sheet using an inhibitor-less technique that does not require performing slab heating at high temperature in the manufacturing process, and that can produce a grain-oriented electrical steel sheet with excellent magnetic properties at low cost accordingly.

Solution to Problem

Previously, we repeatedly studied how Goss-oriented grains secondary recrystallize.

As a result, we revealed that grain boundaries having a misorientation angle of 20° to 45° from the Goss orientation in a primary recrystallized texture serve an important role for preferential recrystallization of Goss-oriented grains, as reported in *Acta Mater.*, Vol. 45, 1997, p. 1285.

We further investigated the primary recrystallization texture immediately before the secondary recrystallization of a grain-oriented electrical steel sheet, and analyzed the misorientation angles of grain boundaries surrounding grains with various crystal orientations. As a result, we discovered that the probability of grain boundaries having a misorientation angle of 20° to 45° is the highest around the Goss-oriented grains.

According to the experimental data reported by C. G. Dunn et al., *AIME Transaction* 188 (1949), p. 368, grain boundaries having a misorientation angle of 20° to 45° are high-energy grain boundaries. The high-energy grain boundaries contain a large free space, and thus have a disordered structure. Diffusion along grain boundaries is a process in which atoms move through the grain boundaries, and thus the high-energy grain boundaries containing a large free space have a high diffusion rate.

In the case of using inhibitors, growth of Goss-oriented grains occurs during final annealing, because diffusion of high-energy grain boundaries is fast, and thus pinning of precipitates on high-energy grain boundaries is preferentially removed to allow initiation of grain boundary migration. This is believed to be one possible cause of growth of Goss grains.

Further development of the above research revealed that a fundamental factor of preferential secondary recrystallization of Goss-oriented grains is the distribution state of high-energy grain boundaries in the primary recrystallization texture, and that inhibitors serve to produce a difference in moving velocity between high-energy grain boundaries and other grain boundaries. Therefore, according to this theory, if the difference in moving velocity between grain boundaries can be produced, then secondary recrystallization of Goss-oriented grains can be caused without using inhibitors.

Since impurity elements present in steel tend to segregate to grain boundaries, particularly high-energy grain boundaries, there is possibly no difference in moving velocity between high-energy grain boundaries and other grain boundaries when the concentration of impurity elements is high. However, by increasing the purity of the material to eliminate the influence of impurity elements, the inherent difference in moving velocity depending upon the structure of high-energy grain boundaries would become apparent enough to permit secondary recrystallization of Goss-oriented grains.

Therefore, in order to solve the problem that the inhibitorless technique is insufficient in terms of quality and stability of magnetic properties, we conducted diligent research into techniques for causing favorable secondary recrystallization by increasing the purity of the steel material and by controlling the primary recrystallized texture.

As a result, we discovered that the primary recrystallized texture and magnetic properties can be improved by increasing both the total rolling reduction in final cold rolling (hereinafter also referred to as "total cold rolling reduction") and the rolling reduction per pass in final cold rolling, and, at the same time, reducing the surface roughness of work rolls in the mill. The following provides a description of the experimental results serving as a foundation for the present disclosure.

(Experiment 1)

Continuously cast slabs, each having a composition containing, in mass % or in mass ppm, C: 0.03%, Si: 3.2%, Mn: 0.08%, P: 0.05%, Cu: 0.10%, Sb: 0.03%, sol.Al: 60 ppm, N: 30 ppm, S: 20 ppm, Se: 1 ppm, and O: 12 ppm, and the balance consisting of Fe and incidental impurities, were heated to 1220° C. and hot rolled to obtain hot rolled sheets having a sheet thickness of 2.5 mm. Then, the hot rolled sheets were subjected to hot band annealing at 1050° C. for 30 seconds, followed by cold rolling using a reverse rolling mill, to thereby obtain cold rolled sheets. The cold rolling was performed with a fixed rolling reduction per pass, and under different conditions, as presented in Table 1, by varying the number of passes and the mean surface roughness Ra of work rolls (hereinafter also referred to simply as "surface roughness Ra"). For the final pass of the cold rolling, work rolls having an equal surface roughness Ra of 0.10 μm were used so that the steel sheets after rolling would be nearly equal in surface roughness Ra. In Table 1, the surface roughness Ra of work rolls for the first pass is presented in the column of "Before rolling," that for the second pass in "After 1st pass," and so on.

After the cold rolling, the cold rolled sheets obtained were subjected to decarburization annealing with soaking at 840° C. for 120 seconds, under a set of conditions of hydrogen partial pressure=55 vol %, nitrogen partial pressure=45 vol %, and dew point=55° C., to thereby obtain decarburization annealed sheets. After the decarburization annealing, X-ray diffraction was used to examine the texture of each decarburization annealed sheet. The % representations below indicating hydrogen partial pressures and nitrogen partial pressures are in vol %.

Samples were cut out from the decarburization annealed sheets, and 12.5 g/m$^2$ of an annealing separator mainly composed of MgO was applied and dried on both sides of each sample. Then, secondary recrystallization annealing was carried out in a manner that the temperature was raised up to 800° C. at 15° C./h, then from 800° C. up to 850° C. at 5° C./h, and retained at 850° C. for 50 hours, and subsequently raised up to 1180° C. at 15° C./h and retained at 1180° C. for 5 hours. Atmospheric gases used in the secondary recrystallization annealing were $N_2$ gas up to 850° C. and $H_2$ gas from 850° C. and above.

TABLE 1

| Experiment No. | Number of passes | Conditions | Before rolling | After 1st pass | After 2nd pass | After 3rd pass | After 4th pass | After 5th pass | After 6th pass | After 7th pass | After 8th pass | Remarks |
|---|---|---|---|---|---|---|---|---|---|---|---|---|
| 1 | 4 passes | Sheet Thickness (mm) | 2.5 | 1.43 | 0.81 | 0.46 | 0.26 | — | — | — | — | Rolling reduction per pass: 43% |
| | | Work roll's Ra (μm) | 0.1 | 0.1 | 0.1 | 0.1 | — | — | — | — | — | |
| 2 | | Sheet Thickness (mm) | 2.5 | 1.43 | 0.81 | 0.46 | 0.26 | — | — | — | — | |
| | | Work roll's Ra (μm) | 0.25 | 0.25 | 0.25 | 0.1 | — | — | — | — | — | |
| 3 | | Sheet Thickness (mm) | 2.5 | 1.43 | 0.81 | 0.46 | 0.26 | — | — | — | — | |
| | | Work roll's Ra (μm) | 0.35 | 0.35 | 0.35 | 0.1 | — | — | — | — | — | |
| 4 | 5 passes | Sheet Thickness (mm) | 2.5 | 1.6 | 1.02 | 0.66 | 0.42 | 0.26 | — | — | — | Rolling reduction per pass: 36% |
| | | Work roll's Ra (μm) | 0.1 | 0.1 | 0.1 | 0.1 | 0.1 | — | — | — | — | |
| 5 | | Sheet Thickness (mm) | 2.5 | 1.6 | 1.02 | 0.66 | 0.42 | 0.26 | — | — | — | |
| | | Work roll's Ra (μm) | 0.25 | 0.25 | 0.25 | 0.25 | 0.1 | — | — | — | — | |
| 6 | | Sheet Thickness (mm) | 2.5 | 1.6 | 1.02 | 0.66 | 0.42 | 0.26 | — | — | — | |

TABLE 1-continued

| Experiment No. | Number of passes | Conditions | Before rolling | After 1st pass | After 2nd pass | After 3rd pass | After 4th pass | After 5th pass | After 6th pass | After 7th pass | After 8th pass | Remarks |
|---|---|---|---|---|---|---|---|---|---|---|---|---|
| | | Work roll's Ra (μm) | 0.35 | 0.35 | 0.35 | 0.35 | 0.1 | — | — | — | — | |
| 7 | 6 passes | Sheet Thickness (mm) | 2.5 | 1.73 | 1.19 | 0.82 | 0.57 | 0.39 | 0.26 | — | — | Rolling reduction per pass: 31% |
| | | Work roll's Ra (μm) | 0.1 | 0.1 | 0.1 | 0.1 | 0.1 | 0.1 | — | — | — | |
| 8 | | Sheet Thickness (mm) | 2.5 | 1.73 | 1.19 | 0.82 | 0.57 | 0.39 | 0.26 | — | — | |
| | | Work roll's Ra (μm) | 0.25 | 0.25 | 0.25 | 0.25 | 0.25 | 0.1 | — | — | — | |
| 9 | | Sheet Thickness (mm) | 2.5 | 1.73 | 1.19 | 0.82 | 0.57 | 0.39 | 0.26 | — | — | |
| | | Work roll's Ra (μm) | 0.35 | 0.35 | 0.35 | 0.35 | 0.35 | 0.35 | — | — | — | |
| 10 | 7 passes | Sheet Thickness (mm) | 2.5 | 1.83 | 1.33 | 0.97 | 0.71 | 0.52 | 0.38 | 0.26 | — | Rolling reduction per pass: 27% |
| | | Work roll's Ra (μm) | 0.1 | 0.1 | 0.1 | 0.1 | 0.1 | 0.1 | 0.1 | — | — | |
| 11 | | Sheet Thickness (mm) | 2.5 | 1.83 | 1.33 | 0.97 | 0.71 | 0.52 | 0.38 | 0.26 | — | |
| | | Work roll's Ra (μm) | 0.25 | 0.25 | 0.25 | 0.25 | 0.25 | 0.25 | 0.1 | — | — | |
| 12 | | Sheet Thickness (mm) | 2.5 | 1.83 | 1.33 | 0.97 | 0.71 | 0.52 | 0.38 | 0.26 | — | |
| | | Work roll's Ra (μm) | 0.35 | 0.35 | 0.35 | 0.35 | 0.35 | 0.35 | 0.1 | — | — | |
| 13 | 8 passes | Sheet Thickness (mm) | 2.5 | 1.9 | 1.44 | 1.1 | 0.83 | 0.63 | 0.48 | 0.37 | 0.26 | Rolling reduction per pass: 24% |
| | | Work roll's Ra (μm) | 0.1 | 0.1 | 0.1 | 0.1 | 0.1 | 0.1 | 0.1 | 0.1 | — | |
| 14 | | Sheet Thickness (mm) | 2.5 | 1.9 | 1.44 | 1.1 | 0.83 | 0.63 | 0.48 | 0.37 | 0.26 | |
| | | Work roll's Ra (μm) | 0.25 | 0.25 | 0.25 | 0.25 | 0.25 | 0.25 | 0.25 | 0.1 | — | |
| 15 | | Sheet Thickness (mm) | 2.5 | 1.9 | 1.44 | 1.1 | 0.83 | 0.63 | 0.48 | 0.37 | 0.26 | |
| | | Work roll's Ra (μm) | 0.35 | 0.35 | 0.35 | 0.35 | 0.35 | 0.35 | 0.35 | 0.1 | — | |

FIG. 1 illustrates the relationship between the rolling reduction per pass in cold rolling and the magnetic flux density after secondary recrystallization annealing, in which the measurements of surface roughness Ra of work rolls except for the final pass appear as parameters.

It can be seen from FIG. 1 that the magnetic flux density is remarkably improved by increasing the rolling reduction per pass in cold rolling to 35% or more, and by reducing the surface roughness Ra of work rolls except for the final pass.

FIG. 2 illustrates the relationship between the rolling reduction per pass in cold rolling and the intensity of {554}<225> orientation, which is the main grain orientation of decarburization annealed sheets, in which the measurements of surface roughness Ra of work rolls except for the final pass appear as parameters.

It can be seen from FIG. 2 that the intensity of main grain orientation, {554}<225>, is remarkably improved by increasing the rolling reduction per pass in cold rolling to 35% or more, and by reducing the surface roughness Ra of work rolls except for the final pass.

FIG. 3 illustrates the relationship between the rolling reduction per pass in cold rolling and the intensity of Goss orientation, in which the measurements of surface roughness Ra of work rolls except for the final pass appear as parameters.

It can be seen from FIG. 3 that although the intensity of Goss orientation tends to decrease with increasing rolling reduction per pass in cold rolling and with decreasing surface roughness of work rolls except for the final pass, the amount of change is small.

(Experiment 2)

Next, continuously cast slabs, each having the same composition as that described in Experiment 1, were heated to 1220° C. and hot rolled to obtain hot rolled sheets having a sheet thickness of 2.5 mm. Then, the hot rolled sheets were subjected to hot band annealing at 1050° C. for 30 seconds, followed by cold rolling using a reverse rolling mill, to thereby obtain cold rolled sheets. The cold rolling was performed with a fixed rolling reduction per pass and a fixed surface roughness of work rolls (Ra=0.10 μm), and under different conditions, as presented in Table 2, by varying the number of passes and the total rolling reduction. In Table 2, the rolling reduction per pass and the measurements of surface roughness Ra of work rolls for the first pass are presented in the column of "Before rolling," those for the second pass in "After 1st pass," and so on.

After the cold rolling, the cold rolled sheets obtained were subjected to decarburization annealing with soaking at 840° C. for 120 seconds under a set of conditions of hydrogen partial pressure=55%, nitrogen partial pressure=45%, and dew point=55° C., to thereby obtain decarburization annealing sheets.

Samples were cut out from the decarburization annealed sheets, and 12.5 g/m$^2$ of an annealing separator containing MgO as a main component and 8 mass % of magnesium sulfate was applied and dried on both sides of each sample. Then, secondary recrystallization annealing was carried out in a manner that the temperature was raised up to 800° C. at 15° C./h, then from 800° C. up to 850° C. at 5° C./h, and retained at 850° C. for 50 hours, and subsequently raised up to 1180° C. at 15° C./h and retained at 1180° C. for 5 hours. Atmospheric gases used in the secondary recrystallization annealing were $N_2$ gas up to 850° C. and $H_2$ gas from 850° C. and above.

TABLE 2

| Experiment No. | Total number of passes | Sheet Thickness (mm) Before rolling | After 1st pass | After 2nd pass | After 3rd pass | After 4th pass | After 5th pass | After 6th pass | Remarks |
|---|---|---|---|---|---|---|---|---|---|
| 1 | 4 passes | 2.5 | 1.6 | 1.02 | 0.66 | 0.42 | — | — | Rolling reduction per pass: 36% Total cold rolling reduction: 83.2% |
| 2 | 5 passes | 2.5 | 1.6 | 1.02 | 0.66 | 0.42 | 0.27 | — | Rolling reduction per pass: 36% Total cold rolling reduction: 89.3% |
| 3 | 6 passes | 2.5 | 1.6 | 1.02 | 0.66 | 0.42 | 0.27 | 0.17 | Rolling reduction per pass: 36% Total cold rolling reduction: 93.1% |
| 4 | 4 passes | 2.5 | 1.68 | 1.12 | 0.75 | 0.5 | — | — | Rolling reduction per pass: 33% Total cold rolling reduction: 79.8% |
| 5 | 5 passes | 2.5 | 1.68 | 1.12 | 0.75 | 0.5 | 0.34 | — | Rolling reduction per pass: 33% Total cold rolling reduction: 86.5% |
| 6 | 6 passes | 2.5 | 1.68 | 1.12 | 0.75 | 0.5 | 0.34 | 0.23 | Rolling reduction per pass: 33% Total cold rolling reduction: 91.0% |

FIG. 4 illustrates the magnetic flux density after secondary recrystallization annealing.

FIG. 4 demonstrates that the magnetic flux density decreases if the total cold rolling reduction is low, despite using work rolls with a reduced surface roughness Ra and increasing the rolling reduction per pass. In other words, according to FIG. 4, a good magnetic flux density can be obtained when the total cold rolling reduction is 85% or more.

As a conventional cold rolling technique using inhibitors, as illustrated in FIG. 2 of JP3873309B (PTL 5), increasing the number of passes, that is, lowering the rolling reduction per pass is known to improve the magnetic flux density. The reason for this is described that the frequency with which grains with the {110}<001> orientation exist in a region ranging from the surface of the steel sheet to a certain depth in the sheet thickness direction, that is, the frequency of grains with the Goss orientation increases after cold rolling.

With the inhibitor-less technique according to the disclosure, as illustrated in FIG. 1, the magnetic flux density was improved by increasing the rolling reduction per pass in cold rolling. One possible cause is considered to be an increase in the intensity of main grain orientation, {554}<225>, in the decarburization annealed sheets as illustrated in FIG. 2. The {554}<225> orientation has a misorientation angle of 30° from the Goss orientation That is, with the inhibitor-less technique according to the disclosure, more grains were formed within high-energy grain boundaries having a misorientation angle of 20° to 45° and secondary recrystallization of Goss-oriented grains was promoted accordingly, resulting in an increase in the magnetic flux density of the steel sheets.

As illustrated in FIG. 3, the decarburization annealed sheets showed only a minor change in the intensity of Goss orientation. One possible cause is considered to be that inhibitor-less techniques tend to cause coarsening of grains before final cold rolling. That is, it is believed that if grains in a steel sheet before subjection to final cold rolling are coarse, formation of Goss-oriented grains, which are considered to begin to form from the inside of grains, proceeds easily as compared with the techniques using inhibitors in which grains before final cold rolling are kept fine due to the presence of inhibitors.

This may prevent the decrease in intensity of Goss-orientation even if the rolling reduction per pass in cold rolling and the total cold rolling reduction are increased. It is also believed that an increase in grains with the {554}<225> orientation as a result of increasing the cold rolling reduction works advantageously for secondary recrystallization of Goss-oriented grains. This is a phenomenon specific to the inhibitor-less technology.

The following provides a description of our findings on the surface roughness of work rolls in the final cold rolling.

As is well known in the art, the surface roughness of a steel sheet affects magnetic properties. It is also known in the art as described in JPS5938326A (PTL 6) that magnetic properties can be improved by smoothing the surface of a steel sheet, or setting the surface roughness Ra to 0.35 or less. To this end, bright rolls with Ra of 0.35 or less are commonly used in the final pass during final cold rolling.

As is well known in the art, it is also effective to increase the friction coefficient for a rolling step preceding the final cold rolling and to increase the intensity of Goss orientation by shear force.

For example, JPH2175010A (PTL 7) describes a technique of using scratch dull rolls with Ra of 0.30 or more. In addition, JPH11199933A (PTL 8) describes a technique in which the surface roughness Ra of rolls in the first stand in the second cold rolling is set to 1.0 μm or more, and obliquely polished rolls are used in the second and subsequent stands. Moreover, JP2011143440A (PTL 9) describes a technique for increasing frictional force by using, in one or more passes in the final cold rolling, work rolls having cross polishing marks that are composed of polishing marks formed at an inclination of 2° to less than 90° with respect to the circumferential direction of the work rolls and other polishing marks formed at an inclination of 0° to less than 90° in an opposite direction to the direction in which the former polishing marks are formed.

In the present disclosure, the magnetic properties of steel sheets are improved by reducing not only the surface roughness of work rolls used in the final pass in the final cold rolling, but also the surface roughness of work rolls upstream of those used in the final pass. On the other hand, with techniques using inhibitors, such rolling processes have been believed to be more advantageous that involve high-friction rolling in passes other than the final pass to form more grains with the Goss orientation.

This difference is considered to reflect the fact that inhibitor-less techniques facilitate formation of Goss-oriented grains during cold rolling, and rather, to obtain improved magnetic properties, it is more advantageous to reduce the surface roughness of work rolls for frictional force reduction and increase the frequency of grains with the {554}<225> orientation. This is also considered to be a phenomenon specific to the inhibitor-less technology, similar to the aforementioned effect obtained by the rolling reduction per pass.

The present disclosure was completed based on the discoveries made through the above experiments.

Specifically, the primary features of this disclosure are as described below.

(1) A method for manufacturing a grain-oriented electrical steel sheet, the method comprising: heating a steel slab having a composition that contains (consists of), in mass %, C: 0.08% or less, Si: 4.5% or less, and Mn: 0.5% or less, and, in mass ppm, S: less than 50 ppm, Se: less than 50 ppm, O: less than 50 ppm, N: less than 60 ppm, and sol.Al: less than 100 ppm, and the balance consisting of Fe and incidental impurities; subjecting the steel slab to hot rolling to obtain a hot rolled sheet; optionally subjecting the hot rolled sheet to hot band annealing; subjecting the hot rolled sheet to cold rolling either once, or twice or more with intermediate annealing performed therebetween, to thereby obtain a cold rolled sheet having a final thickness; subjecting the cold rolled sheet to decarburization annealing to obtain a decarburization annealed sheet; applying an annealing separator mainly composed of MgO on a surface of the decarburization annealed sheet; and then subjecting the decarburization annealed sheet to secondary recrystallization annealing, wherein the cold rolling comprises final cold rolling with a total cold rolling reduction being set to 85% or more and a rolling reduction per pass being set to 32% or more, and wherein the final cold rolling includes one or more passes followed by a final pass and uses work rolls having a mean surface roughness Ra of 0.25 μm or less in at least one of the one or more passes other than the final pass.

(2) The method for manufacturing a grain-oriented electrical steel sheet according to (1) further comprising: before initiating the final cold rolling, heating both widthwise edges of the steel sheet to be subjected to the final cold rolling to a temperature of 100° C. or higher.

(3) The method for manufacturing a grain-oriented electrical steel sheet according to (1) or (2), wherein the decarburization annealing comprises heating the cold rolled sheet from 500° C. to 700° C. at a heating rate of 50° C./s or higher.

(4) The method for manufacturing a grain-oriented electrical steel sheet according to any one of (1) to (3), wherein the composition further contains, in mass %, one or more selected from the group consisting of Ni: 0.01% to 1.50%, Sn: 0.03% to 0.20%, Sb: 0.01% to 0.20%, P: 0.02% to 0.20%, Cu: 0.05% to 0.50%, Cr: 0.03% to 0.50%, Mo: 0.008% to 0.50%, and Nb: 0.0010% to 0.0100%.

Advantageous Effect

According to the disclosure, it becomes possible to manufacture grain-oriented electrical steel sheets having excellent magnetic properties in an industrially stable manner and at low cost. Therefore, the present disclosure is of extremely high industrial value.

DETAILED DESCRIPTION

Figure 1:
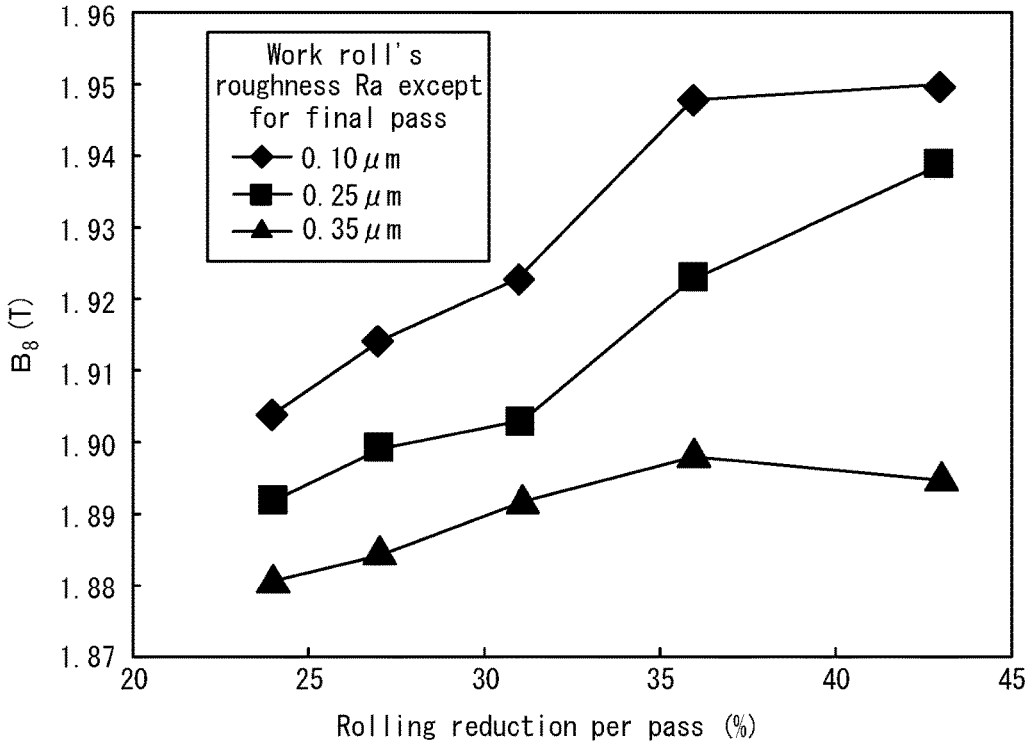
FIG. 1 illustrates the relationship between the rolling reduction per pass in cold rolling and the magnetic flux density after secondary recrystallization annealing.
Figure 2:
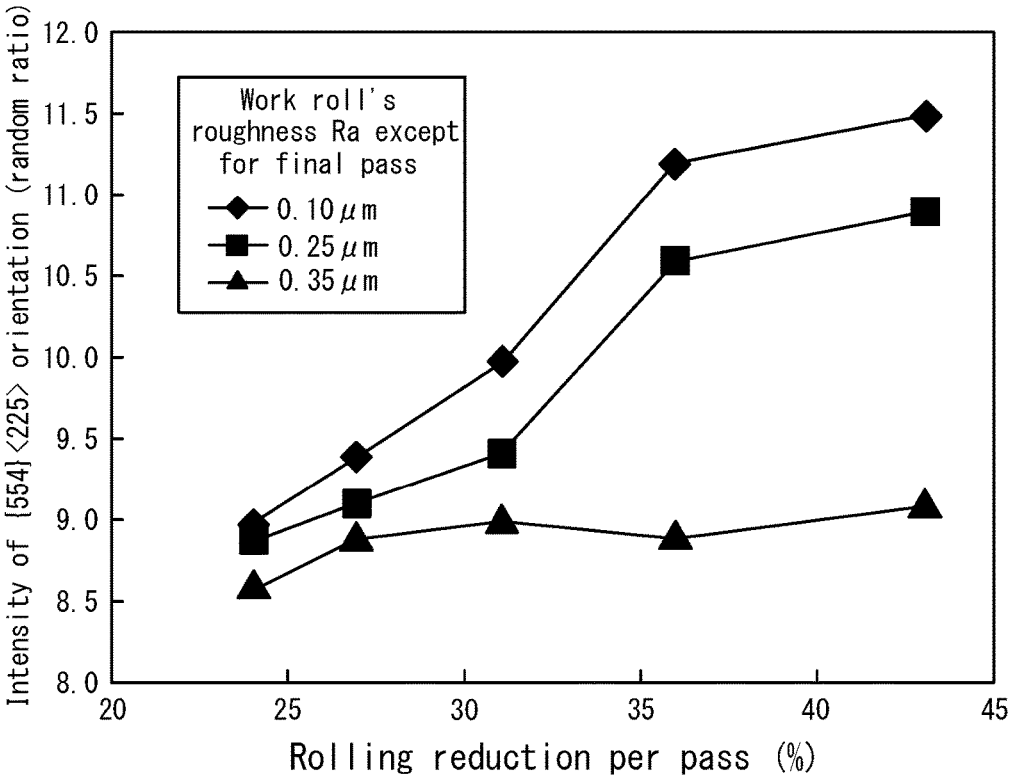
FIG. 2 illustrates the relationship between the rolling reduction per pass in cold rolling and the intensity of grains with the {554}<225> orientation in decarburization annealed sheets.
Figure 3:
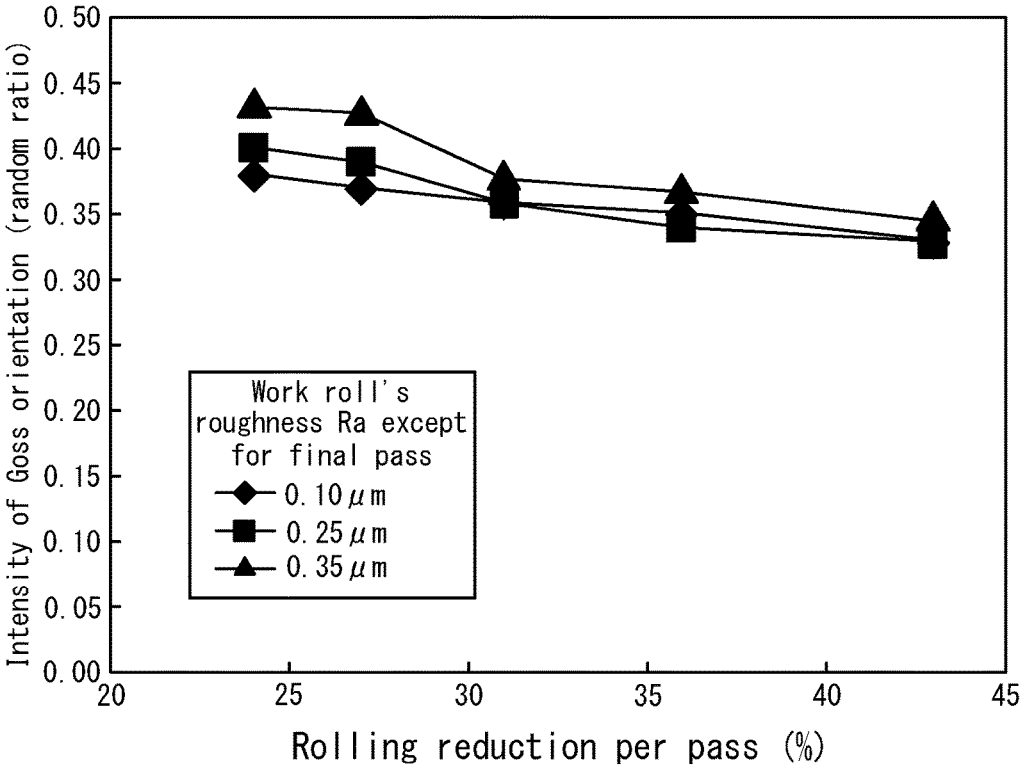
FIG. 3 illustrates the relationship between the rolling reduction per pass in cold rolling and the intensity of Goss orientation in decarburization annealed sheets.
Figure 4:
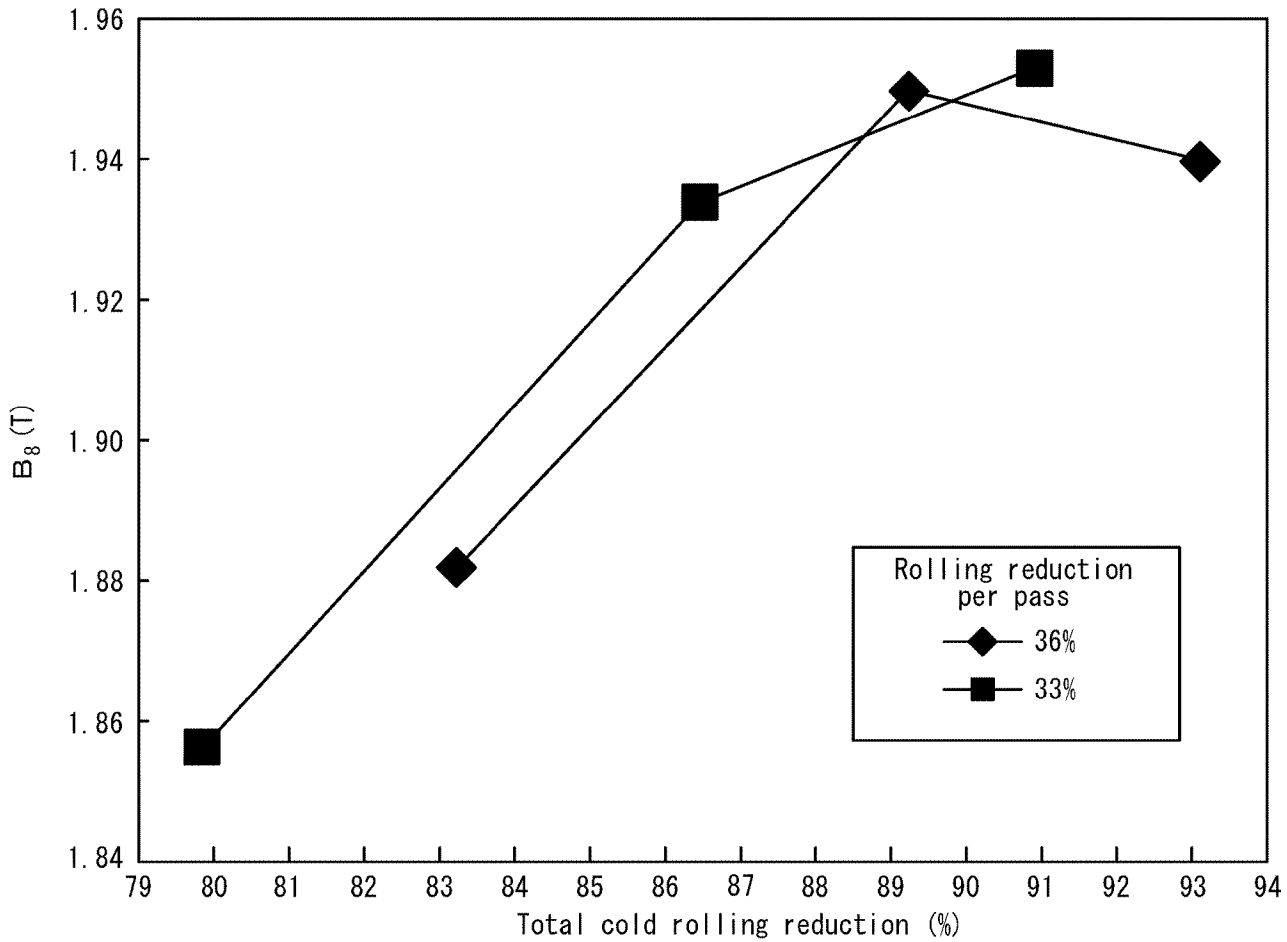
FIG. 4 illustrates the relationship between the total cold rolling reduction and the magnetic flux density of steel sheets after subjection to secondary recrystallization annealing.

Our methods and products will be described in detail below.

First, the reasons for limiting the chemical composition of the steel slab to the aforementioned range will be explained. As used herein, when components are expressed in "%" or "ppm," this refers to "mass %" or "mass ppm" unless otherwise specified. The balance of the composition of the steel sheet or slab consists of Fe and incidental impurities.

C: 0.08% or Less

C is a useful element for establishing an improved primary recrystallized texture. If the content exceeds 0.08%, however, the primary recrystallized texture deteriorates instead. Therefore, the C content is set to 0.08% or less. From the perspective of magnetic properties, the C content is desirably 0.01% or more. The C content is desirably 0.06% or less. If the level of required magnetic properties is not so high, the C content may be set to 0.01% or less in order to omit or simplify decarburization in primary recrystallization annealing. No lower limit is placed on the C content, yet in industrial terms the lower limit is preferably around 0.003%.

Si: 4.5% or Less

Si is a useful element for reducing iron loss by raising the electric resistance. If the content exceeds 4.5%, however, cold rolling manufacturability markedly degrades. Therefore, the Si content is set to 4.5% or less. From the perspective of iron loss, the Si content is desirably 2.0% or more. The Si content is desirably 4.5% or less. Depending on the iron loss level required, Si may not be added to steel.

Mn: 0.5% or Less

Mn has an effect of improving hot workability at the time of production. If the content exceeds 0.5%, however, the primary recrystallized texture deteriorates, leading to deterioration of magnetic properties. Therefore, the Mn content is set to 0.5% or less. No lower limit is placed on the Mn content, yet in industrial terms the lower limit is preferably around 0.05%.

S, Se, and O: Less than 50 ppm Each

When the contents of S, Se, and O are respectively 50 ppm or more, it becomes difficult to ensure proper secondary recrystallization. The reason is that coarse oxides as well as MnS and MnSe coarsened by slab heating increase the non-uniformity of the primary recrystallized texture. Therefore, the contents of S, Se, and O are respectively limited to less than 50 ppm.

N: Less than 60 ppm

If N is excessively added to steel, it becomes difficult to achieve proper secondary recrystallization, as is the case with S, Se, and O. In particular, when the N content is 60 ppm or more, secondary recrystallization hardly occurs and magnetic properties deteriorate. Therefore, the N content is limited to less than 60 ppm.

Sol.Al: Less than 100 ppm

If Al is excessively added to steel, it is also difficult to guarantee proper secondary recrystallization. In particular, when the sol.Al content exceeds 100 ppm, secondary recrystallization becomes difficult under low-temperature slab heating conditions, and magnetic properties deteriorate. Therefore, the content of Al, in terms of sol.Al, is limited to less than 100 ppm. No lower limit is placed on the Al content, yet in industrial terms the lower limit is preferably around 0.003%.

In addition to the essential components described above, the chemical composition disclosed herein may appropriately further contain the following elements as required.

Ni: 0.01% to 1.50%

Ni serves to increase the uniformity of the microstructure of a hot rolled sheet, and thus improve the magnetic properties. To obtain this effect, the Ni content is preferably 0.01% or more. If the content exceeds 1.50%, however, it becomes difficult to ensure proper secondary recrystallization, and magnetic properties deteriorate. Therefore, the Ni content is preferably 0.01% or more. The Ni content is preferably 1.50% or less.

Sn: 0.03% to 0.20%

Sn is a useful element for effectively improving magnetic properties, in particular iron loss properties, by suppressing nitridation and oxidization of the steel sheet during secondary recrystallization annealing and by promoting secondary recrystallization of grains with a preferred orientation. To obtain this effect, the Sn content is preferably 0.03% or more. If the Sn content exceeds 0.20%, however, cold rolling manufacturability degrades. Therefore, the Sn content is desirably 0.03% or more. The Sn content is desirably 0.20% or less.

Sb: 0.01% to 0.20%

Sb is a useful element for improving magnetic properties by suppressing nitridation and oxidation of the steel sheet during secondary recrystallization annealing and by promoting secondary recrystallization of grains with a preferred orientation. To obtain this effect, the Sb content is preferably 0.01% or more. If the content exceeds 0.20%, however, cold rolling manufacturability degrades. Therefore, the Sb content is desirably 0.01% or more. The Sb content is desirably 0.20% or less.

P: 0.02% to 0.20%

P is a useful element for effectively improving magnetic properties by establishing an improved primary recrystallized texture and promoting secondary recrystallization of grains with a preferred orientation. To obtain this effect, the P content is preferably 0.02% or more. If the content exceeds 0.20%, however, cold rolling manufacturability degrades. Therefore, the P content is desirably 0.02% or more. The P content is preferably 0.20% or less.

Cu: 0.05% to 0.50%

Cu serves to effectively improve magnetic properties by suppressing nitridation and oxidation of the steel sheet during secondary recrystallization annealing and by promoting secondary recrystallization of grains with a preferred orientation. To obtain this effect, the Cu content is preferably 0.05% or more. If the content exceeds 0.50%, however, hot rolling manufacturability degrades. Therefore, the Cu content is desirably 0.05% or more. The Cu content is desirably 0.50% or less.

Cr: 0.03% to 0.50%

Cr serves to stabilize forsterite base film formation. To obtain this effect, the Cr content is preferably 0.03% or more. If the content exceeds 0.50%, however, it becomes difficult to ensure proper secondary recrystallization, and magnetic properties deteriorate. Therefore, the Cr content is desirably 0.03% or more. The Cr content is desirably 0.50% or less.

Mo: 0.008% to 0.50%

Mo serves to suppress high-temperature oxidation and reduce occurrence of surface defects called scabs. To obtain this effect, the Mo content is preferably 0.008% or more. If the content exceeds 0.50%, however, cold rolling manufacturability degrades. Therefore, the Mo content is desirably 0.008% or more. The Mo content is desirably 0.50% or less.

Nb: 0.0010% to 0.0100%

Nb is a useful element for improving magnetic properties by suppressing growth of primary recrystallized grains and by promoting secondary recrystallization of grains with a preferred orientation. To obtain this effect, the Nb content is preferably 0.0010% or more. If the content exceeds 0.0100%, however, Nb will remain in the steel substrate, and iron loss properties deteriorate. Therefore, the Nb content is desirably 0.0010% or more. The Nb content is desirably 0.0100% or less.

The following describes a manufacturing method according to the disclosure.

The steel slab adjusted to the compositional range described above is subjected to hot rolling with or without reheating, to obtain a hot rolled sheet. If the steel slab is subjected to reheating before hot rolling, it is preferably reheated to approximately 1000° C. or higher and approximately 1300° C. or lower. This is because increasing the slab heating temperature beyond 1300° C. makes no sense in the present disclosure in which the slab does not contain any inhibitors, and instead, not only does it result in a rise in costs, but also it greatly deteriorates the magnetic properties due to the enlargement of grains, while a slab heating temperature below 1000° C. leads to increased rolling load and a difficulty in rolling the steel sheet.

Then, the hot rolled sheet is optionally subjected to hot band annealing. The hot rolled sheet is subjected to cold rolling once, or twice or more with intermediate annealing performed therebetween, to obtain a cold rolled sheet having a final sheet thickness.

In the disclosure, to improve magnetic properties, it is most important to set a total cold rolling reduction to 85% or more for the final one of the above-described one cold rolling or more than one cold rolling with intermediate annealing performed therebetween, and to set a rolling reduction per pass to 32% or more for the final cold rolling. A preferred rolling reduction per pass in the final cold rolling is 35% or more.

If the total cold rolling reduction or the rolling reduction per pass is outside the aforementioned range, the degree of preferred orientation in the primary recrystallized texture is lowered, and magnetic properties deteriorate. No upper limit is placed on the total cold rolling reduction or the rolling reduction per pass, yet the total cold rolling reduction is set to approximately 92% and the rolling reduction per pass is set to approximately 60%. If these upper limits are exceeded, the problems of increased rolling load, which makes rolling itself difficult, defects such as edge cracks, and increased risk of fracture during rolling may arise.

Furthermore, in order to stably improve magnetic properties, it is important to use work rolls having a surface roughness Ra of 0.25 μm or less in at least one pass other than the final pass in the final cold rolling. The reason is that if work rolls having a surface roughness Ra greater than 0.25 μm are used, frictional force is increased during rolling, and the degree of preferred orientation in the primary recrystallized texture is lowered, which limits the magnetic property improving effect. No lower limit is placed on the surface roughness Ra, yet from the perspective of rollability, the lower limit is approximately 0.03 μm.

As described above, it is necessary for the disclosure to increase both the total cold rolling reduction and the rolling reduction per pass in the final cold rolling, but on the other hand, the possibility of occurrence of edge cracks during cold rolling increases. To reduce the frequency of such edge cracks, it is advantageous to heat both edges in the sheet thickness direction (hereinafter simply referred to as "both widthwise edges") of the steel sheet to be subjected to the final cold rolling to a temperature of 100° C. or higher before initiating the final cold rolling. If the temperature of both widthwise edges is below 100° C., the resulting brittleness improving effect and reduction of edge cracks are insufficient. No upper limit is placed on the heating temperature of both widthwise edges, yet from the perspective of productivity, the upper limit is approximately 400° C.

The cold rolling may be carried out at room temperature, yet from the perspective of establishing a favorable texture and preventing crack formation, it is advantageous to perform warm rolling in which the steel sheet is rolled at a raised temperature, such as about 200° C., higher than normal temperature.

After the final cold rolling, the resulting cold rolled sheet is subjected to decarburization annealing.

The primary objective of this decarburization annealing is to primary recrystallize the cold rolled sheet and adjust it to a primary recrystallized texture optimum for secondary recrystallization. To this end, it is desirable to set the annealing temperature for decarburization annealing to approximately 800° C. or higher. The annealing temperature for decarburization annealing is desirably set to lower than approximately 950° C. At this time, the annealing atmosphere is desirably a wet hydrogen-nitrogen atmosphere or a wet hydrogen-argon atmosphere.

A secondary objective of the decarburization annealing is to decarburize the steel sheet. If the steel sheet contains more than 50 ppm of carbon, iron loss increases. Therefore, the carbon content is desirably reduced to 50 ppm or less.

Further, a tertiary objective of the decarburization annealing is to form a subscale composed of an internal oxidation layer of $SiO_2$, which will be used as the material for a base film mainly composed of forsterite.

In the disclosure, in order to adjust the subscales to an appropriate range, to adjust the primary recrystallized grains to a grain size suitable for secondary recrystallization, and to further improve the magnetic properties, it is effective to control the decarburization annealing temperature so that it will be highest in the latter part of the decarburization annealing. In the case of increasing the temperature in the latter part of the decarburization annealing, it is preferable to lower the dew point as much as possible so as to avoid an excess of oxygen per unit area. The maximum temperature is suitably set to 860° C. or higher and the atmospheric oxidizability defined by $P(H_2O)/P(H_2)$ to 0.10 or less.

In order to properly form subscales, it is effective to control the soaking temperature in the decarburization annealing within a range of 820° C. to 860° C. and the atmospheric oxidizability within a range of 0.20 to 0.50.

The following describes preferred conditions of the temperature before the decarburization annealing and the heating rate during the decarburization annealing.

If the temperature before the decarburization annealing is below 800° C., the oxidation and decarburization reactions do not proceed sufficiently, making it impossible to guarantee a necessary amount of oxidation in steel or to successfully complete decarburization.

During heating in the decarburization annealing, setting the heating rate to 50° C./s or higher in a temperature range from 500° C. to 700° C. can reduce iron loss. Therefore, during the heating in the decarburization annealing, the heating rate is preferably set to 50° C./s or higher in a temperature range from 500° C. to 700° C. No upper limit is placed on the heating rate in a temperature range from 500° C. to 700° C., yet from the perspective of productivity, the upper limit is approximately 500° C./s.

Moreover, in the disclosure, after the decarburization annealing, an annealing separator mainly composed of magnesia (MgO) is applied to a surface of the steel sheet. Subsequently, secondary recrystallization annealing is carried out in a conventional manner.

In addition, according to the disclosure, in order to further improve magnetic properties, it is possible to perform sulfurization treatment to increase the S content in the steel substrate during the period from the decarburization annealing to the completion of the secondary recrystallization.

As such sulfurization treatment, it is advantageous to add sulfide and/or sulfate in an amount of 1.0 mass % to 15.0 mass % to the annealing separator mainly composed of MgO.

According to the disclosure, after the aforementioned secondary recrystallization annealing, an insulating coating may be applied to and baked on the surface of the steel sheet. Such insulating coating is not limited to a particular type, and any insulating coating known in the art is suitably used. Particularly preferred insulating coatings are, for example, those described in JPS5079442A and JPS4839338A that are formed by applying a coating solution containing phosphate-chromate-colloidal silica on a steel sheet and baking it at approximately 800° C.

It is also possible to shape the steel sheet by flattening annealing. The flattening annealing may also be combined with baking of the insulating coating.

EXAMPLES

Example 1

Continuously cast slabs, each having a composition containing C: 0.03%, Si: 3.5%, Mn: 0.08%, sol.Al: 75 ppm, N: 45 ppm, S: 30 ppm, Se: 1 ppm, O: 9 ppm, P: 0.06%, and Cu: 0.10, and the balance consisting of Fe and incidental impurities, were reheated to 1200° C., and hot rolled into hot rolled sheets having a sheet thickness of 2.5 mm. The hot rolled sheets were then subjected to hot band annealing at 1050° C. for 30 seconds. Then, the temperature of both widthwise edges of each hot rolled sheet was raised to 200° C. by induction heating prior to the final cold rolling. After that, the hot rolled sheets were respectively cold rolled into cold rolled sheets having a sheet thickness of 0.26 mm under the conditions presented in Table 3. Subsequently, decarburization annealing was carried out under a set of conditions of heating rate=20° C./s in a temperature range from 500° C. to 700° C., subsequent soaking=850° C. for 120 s, in an atmosphere of 55% $H_2$: 45% $N_2$ with a dew point of 55° C.

After the decarburization annealing, 12.5 g/m$^2$ of an annealing separator having a mixing ratio of MgO=90 mass %, $MgSO_4$=5 mass %, and $TiO_2$=5 mass %, was applied and dried on both sides of each decarburization annealed sheet.

Then, secondary recrystallization annealing was carried out under the conditions such that the temperature was raised up to 800° C. at 15° C./h, then from 800° C. up to 850° C. at 2.0° C./h, and retained at 850° C. for 50 hours, and subsequently raised up to 1160° C. at 5.0° C./h and retained at 1160° C. for 5 hours, to thereby obtain secondary recrystallization annealed sheets. Atmospheric gases used in the secondary recrystallization annealing were $N_2$ gas up to 850° C. and $H_2$ gas from 850° C. and above.

A coating solution containing phosphate-chromate-colloidal silica at a mass ratio of 3:1:3 was applied to the surface of each secondary recrystallization annealed sheet obtained under the above conditions, and baked thereon at 800° C. After that, we examined the magnetic properties of the obtained steel sheets.

The magnetic properties were evaluated by measuring the magnetic flux density $B_8$ at 800 A/m in each steel sheet after subjection to stress relief annealing at 800° C. for 3 hours, and the iron loss $W_{17/50}$ when excited by AC current up to 1.7 T at 50 Hz.

The obtained results are listed in Table 3. In Table 3, the rolling reduction per pass and the surface roughness Ra of work rolls for the first pass are presented in the column of "Before rolling," those for the second pass in "After 1st pass," and so on.

TABLE 3

| Experiment No. | Conditions | Before rolling | After 1st pass | After 2nd pass | After 3rd pass | After 4th pass | After 5th pass | Total cold rolling reduction (%) | $B_8$ (T) | $W_{17/50}$ (W/kg) | Remarks |
|---|---|---|---|---|---|---|---|---|---|---|---|
| 1 | Sheet Thickness (mm) | 2.50 | 1.60 | 1.02 | 0.66 | 0.44 | 0.29 | 88.4 | 1.950 | 0.93 | Example |
| | Rolling reduction per pass (%) | 36 | 36 | 36 | 33 | 34 | — | | | | |
| | Work roll's Ra (μm) | 0.25 | 0.25 | 0.25 | 0.15 | 0.10 | — | | | | |
| 2 | Sheet Thickness (mm) | 2.50 | 1.60 | 1.02 | 0.66 | 0.44 | 0.29 | 88.4 | 1.955 | 0.91 | Example |
| | Rolling reduction per pass (%) | 36 | 36 | 36 | 33 | 34 | — | | | | |
| | Work roll's Ra (μm) | 0.10 | 0.10 | 0.10 | 0.10 | 0.10 | — | | | | |
| 3 | Sheet Thickness (mm) | 2.50 | 1.43 | 0.81 | 0.44 | 0.29 | — | 88.4 | 1.960 | 0.90 | Example |
| | Rolling reduction per pass (%) | 43 | 43 | 46 | 34 | — | — | | | | |
| | Work roll's Ra (μm) | 0.25 | 0.25 | 0.15 | 0.10 | — | — | | | | |
| 4 | Sheet Thickness (mm) | 2.50 | 1.23 | 0.60 | 0.29 | — | — | 88.4 | 1.957 | 0.91 | Example |
| | Rolling reduction per pass (%) | 51 | 51 | 51 | — | — | — | | | | |
| | Work roll's Ra (μm) | 0.25 | 0.15 | 0.10 | — | — | — | | | | |
| 5 | Sheet Thickness (mm) | 2.50 | 1.60 | 1.02 | 0.66 | 0.44 | 0.29 | 88.4 | 1.920 | 0.99 | Comparative Example |
| | Rolling reduction per pass (%) | 36 | 36 | 36 | 33 | 34 | — | | | | |
| | Work roll's Ra (μm) | 0.35 | 0.35 | 0.35 | 0.35 | 0.10 | — | | | | |
| 6 | Sheet Thickness (mm) | 2.50 | 1.60 | 1.02 | 0.55 | 0.39 | 0.29 | 88.4 | 1.910 | 1.03 | Comparative Example |
| | Rolling reduction per pass (%) | 36 | 36 | 46 | 29 | 26 | — | | | | |
| | Work roll's Ra (μm) | 0.25 | 0.25 | 0.25 | 0.15 | 0.10 | — | | | | |
| 7 | Sheet Thickness (mm) | 2.50 | 1.60 | 1.02 | 0.55 | — | — | 78.0 | 1.872 | 1.63 | Comparative Example |
| | Rolling reduction per pass (%) | 36 | 36 | 46 | — | — | — | | | | |
| | Work roll's Ra (μm) | 0.25 | 0.15 | 0.10 | — | — | — | | | | |

As is apparent from Table 3, in those cases satisfying the conditions specified in the disclosure, in which the total cold rolling reduction in the final cold rolling was set to 85% or more, the rolling reduction per pass was set to 32% or more, and work rolls having a surface roughness Ra of 0.25 μm or less were used in at least one pass other than the final pass, the resulting grain-oriented electrical steel sheets exhibited good magnetic properties.

Example 2

Continuously cast slabs, each having a composition containing C: 0.025%, Si: 3.4%, Mn: 0.10%, sol.Al: 70 ppm, N: 42 ppm, S: 20 ppm, Se: 2 ppm, O: 30 ppm, P: 0.07%, and Cu: 0.08%, and the balance consisting of Fe and incidental impurities, were reheated to 1220° C., and hot rolled into hot rolled sheets having a sheet thickness of 2.2 mm. The hot rolled sheets were then subjected to hot band annealing at 1050° C. for 30 seconds. Then, the temperature of both widthwise edges of each hot rolled sheet was raised by induction heating as presented in Table 4 prior to the final cold rolling. After that, the hot rolled sheets were respectively cold rolled into cold rolled sheets in a tandem type mill. After the cold rolling, we examined the cold rolled sheets for edge cracks. The maximum edge crack depth is listed in Table 4.

Subsequently, decarburization annealing was carried out under a set of conditions of heating rate=as presented in Table 4 in a temperature range from 500° C. to 700° C., subsequent soaking=850° C. for 120 s, in an atmosphere of 55% $H_2$: 45% $N_2$ with a dew point of 50° C.

After the decarburization annealing, 12.5 g/$m^2$ of an annealing separator having a mixing ratio of MgO=90 mass %, $MgSO_4$=5 mass %, and $TiO_2$=5 mass %, was applied and dried on both sides of each decarburization annealed sheet. Then, secondary recrystallization annealing was carried out under the conditions such that the temperature was raised up to 800° C. at 15° C./h, then from 800° C. up to 840° C. at 2.0° C./h, and retained at 840° C. for 50 hours, and subsequently raised up to 1160° C. at 5.0° C./h and retained at 1160° C. for 5 hours, to thereby obtain secondary recrystallization annealed sheets. Atmospheric gases used in the secondary recrystallization annealing were $N_2$ gas up to 840° C. and $H_2$ gas from 840° C. and above.

A coating solution containing phosphate-chromate-colloidal silica at a mass ratio of 3:1:3 was applied to the surface of each secondary recrystallization annealed sheet obtained under the above conditions, and baked thereon at 800° C. After that, we examined the magnetic properties at the widthwise central portion of each coil. The magnetic properties were evaluated by measuring the magnetic flux density $B_8$ at 800 A/m in each steel sheet after subjection to stress relief annealing at 800° C. for 3 hours, and the iron loss $W_{17/50}$ when excited by AC current up to 1.7 T at 50 Hz.

Table 4 lists the results. In Table 4, the rolling reduction per pass and the surface roughness Ra of work rolls for the first pass are presented in the column of "Before rolling," those for the second pass in "After 1st pass," and so on.

TABLE 4

| Experiment No. | Temperature of edges before rolling (° C.) | Conditions | Before rolling | After 1st pass | After 2nd pass | After 3rd pass | After 4th pass | Total cold rolling reduction (%) |
|---|---|---|---|---|---|---|---|---|
| 1 | 200 | Sheet Thickness (mm) | 2.20 | 1.23 | 0.69 | 0.39 | 0.22 | 90.0 |
| | | Rolling reduction per pass (%) | 44 | 44 | 44 | 44 | — | |
| | | Work roll's Ra (μm) | 0.25 | 0.25 | 0.15 | 0.10 | 0.10 | |
| 2 | 100 | Sheet Thickness (mm) | 2.20 | 1.23 | 0.69 | 0.39 | 0.22 | 90.0 |
| | | Rolling reduction per pass (%) | 44 | 44 | 44 | 44 | — | |
| | | Work roll's Ra (μm) | 0.25 | 0.25 | 0.15 | 0.10 | — | |
| 3 | 70 | Sheet Thickness (mm) | 2.20 | 1.23 | 0.69 | 0.39 | 0.22 | 90.0 |
| | | Rolling reduction per pass (%) | 44 | 44 | 44 | 44 | — | |
| | | Work roll's Ra (μm) | 0.25 | 0.25 | 0.15 | 0.10 | — | |
| 4 | 30 | Sheet Thickness (mm) | 2.20 | 1.23 | 0.69 | 0.39 | 0.22 | 90.0 |
| | | Rolling reduction per pass (%) | 44 | 44 | 44 | 44 | — | |
| | | Work roll's Ra (μm) | 0.25 | 0.25 | 0.15 | 0.10 | — | |
| 5 | 200 | Sheet Thickness (mm) | 2.20 | 1.23 | 0.69 | 0.39 | 0.22 | 90.0 |
| | | Rolling reduction per pass (%) | 44 | 44 | 44 | 44 | — | |
| | | Work roll's Ra (μm) | 0.25 | 0.25 | 0.15 | 0.10 | — | |
| 6 | 200 | Sheet Thickness (mm) | 2.20 | 1.23 | 0.69 | 0.39 | 0.22 | 90.0 |
| | | Rolling reduction per pass (%) | 44 | 44 | 44 | 44 | — | |
| | | Work roll's Ra (μm) | 0.25 | 0.25 | 0.15 | 0.10 | — | |
| 7 | 200 | Sheet Thickness (mm) | 2.20 | 1.23 | 0.69 | 0.39 | 0.22 | 90.0 |
| | | Rolling reduction per pass (%) | 44 | 44 | 44 | 44 | — | |
| | | Work roll's Ra (μm) | 0.35 | 0.35 | 0.35 | 0.10 | — | |
| 8 | 200 | Sheet Thickness (mm) | 2.20 | 1.52 | 1.05 | 0.72 | 0.50 | 77.3 |
| | | Rolling reduction per pass (%) | 31 | 31 | 31 | 31 | — | |
| | | Work roll's Ra (μm) | 0.25 | 0.25 | 0.15 | 0.10 | — | |

TABLE 4-continued

| Experiment No. | Temperature of edges before rolling (° C.) | Conditions | Edge crack (mm) | Heating rate from 500° C. to 700° C. (° C./s) | $B_8$ (T) | $W_{17/50}$ (W/kg) | Remarks |
|---|---|---|---|---|---|---|---|
| 1 | 200 | Sheet Thickness (mm)<br>Rolling reduction per pass (%)<br>Work roll's Ra (μm) | 0 | 20 | 1.948 | 0.82 | Example |
| 2 | 100 | Sheet Thickness (mm)<br>Rolling reduction per pass (%)<br>Work roll's Ra (μm) | 1 | 20 | 1.947 | 0.81 | Example |
| 3 | 70 | Sheet Thickness (mm)<br>Rolling reduction per pass (%)<br>Work roll's Ra (μm) | 8 | 20 | 1.947 | 0.81 | Example |
| 4 | 30 | Sheet Thickness (mm)<br>Rolling reduction per pass (%)<br>Work roll's Ra (μm) | 28 | 20 | 1.947 | 0.81 | Example |
| 5 | 200 | Sheet Thickness (mm)<br>Rolling reduction per pass (%)<br>Work roll's Ra (μm) | 0 | 50 | 1.957 | 0.77 | Example |
| 6 | 200 | Sheet Thickness (mm)<br>Rolling reduction per pass (%)<br>Work roll's Ra (μm) | 0 | 150 | 1.960 | 0.75 | Example |
| 7 | 200 | Sheet Thickness (mm)<br>Rolling reduction per pass (%)<br>Work roll's Ra (μm) | 0 | 20 | 1.918 | 0.89 | Comparative Example |
| 8 | 200 | Sheet Thickness (mm)<br>Rolling reduction per pass (%)<br>Work roll's Ra (μm) | 0 | 20 | 1.850 | 1.70 | Comparative Example |

As is apparent from Table 4, in those cases satisfying the conditions specified in the disclosure, in which the total cold rolling reduction in the final cold rolling was set to 85% or more, the rolling reduction per pass was set to 32% or more, and work rolls having a surface roughness Ra of 0.25 μm or less were used in at least one pass other than the final pass, the resulting grain-oriented electrical steel sheets exhibited good magnetic properties. It will also be appreciated that edge cracks can be reduced by setting the temperature of both edges of a steel sheet to 100° C. or higher before initiating the final cold rolling. Moreover, it can be seen that further improvement in magnetic properties can be achieved by rapidly increasing the temperature at a heating rate of 50° C./s or higher in a temperature range from 500° C. to 700° C. during decarburization annealing.

Example 3

Continuously cast slabs having different compositions presented in Table 5 were reheated to 1230° C., and hot rolled into hot rolled sheets having a sheet thickness of 2.2 mm. The hot rolled sheets were then subjected to hot band annealing at 1025° C. for 30 seconds. Then, the temperature of both widthwise edges of each hot rolled sheet was raised to 200° C. by induction heating prior to the final cold rolling. Subsequently, cold rolling was carried out in four passes using a tandem type mill under a set of conditions of rolling reduction per pass=44% and work roll's surface roughness Ra=0.10 μm, to thereby obtain cold rolled sheets having a sheet thickness of 0.22 mm. Samples were collected from the cold rolled sheets, and heated at a heating rate of 150° C./s from 500° C. to 700° C. The samples were then subjected to decarburization annealing, where in the earlier part, they were retained at 840° C. for 100 s in an atmosphere of 55% $H_2$: 45% $N_2$ with a dew point of 55° C., and in the latter part, they were heated to 900° C. in an atmosphere of 55% $H_2$: 45% $N_2$ with a dew point of 20° C.

Then, 12.5 g/$m_2$ of an annealing separator having a mixing ratio of MgO=90 mass %, $MgSO_4$=5 mass %, and $TiO_2$=5 mass %, was applied and dried on both sides of each decarburization annealed sheet. Then, secondary recrystallization annealing was carried out under the conditions such that the temperature was raised up to 800° C. at 15° C./h, then from 800° C. up to 870° C. at 2.0° C./h, and retained at 870° C. for 50 hours, and subsequently raised up to 1160° C. at 5.0° C./h and retained at 1160° C. for 5 hours, to thereby obtain secondary recrystallization annealed sheets. Atmospheric gases used in the secondary recrystallization annealing were $N_2$ gas up to 870° C. and $H_2$ gas from 870° C. and above.

A coating solution containing phosphate-chromate-colloidal silica at a mass ratio of 3:1:3 was applied to the surface of each secondary recrystallization annealed sheet obtained under the above conditions, and baked thereon at 800° C. After that, we examined the magnetic properties at the widthwise central portion of each coil. The magnetic properties were evaluated by measuring the magnetic flux density $B_8$ at 800 A/m in each steel sheet after subjection to stress relief annealing at 800° C. for 3 hours, and the iron loss $W_{17/50}$ when excited by AC current up to 1.7 T at 50 Hz.

Table 5 lists the results.

TABLE 5

| Experiment | Steel slab composition (mass %) | | | | | | | | | $B_8$ | $W_{17/50}$ | |
|---|---|---|---|---|---|---|---|---|---|---|---|---|
| No. | C | Si | Mn | S | Se | O | Al | N | Others | (T) | (W/kg) | Remarks |
| 1 | 0.03 | 3.3 | 0.07 | 0.001 | 0.001 | 0.001 | 0.003 | 0.003 | — | 1.949 | 0.81 | Example |
| 2 | 0.04 | 3.2 | 0.08 | 0.002 | 0.001 | 0.001 | 0.004 | 0.002 | Ni: 0.3 | 1.960 | 0.80 | Example |
| 3 | 0.02 | 3.2 | 0.08 | 0.002 | 0.001 | 0.001 | 0.004 | 0.002 | Sn: 0.1 | 1.950 | 0.77 | Example |
| 4 | 0.03 | 3.4 | 0.11 | 0.001 | 0.001 | 0.001 | 0.005 | 0.003 | Sb: 0.1 | 1.954 | 0.78 | Example |
| 5 | 0.04 | 3.3 | 0.06 | 0.002 | 0.001 | 0.001 | 0.006 | 0.001 | P: 0.08 | 1.955 | 0.79 | Example |
| 6 | 0.03 | 3.1 | 0.07 | 0.001 | 0.001 | 0.001 | 0.004 | 0.003 | Cr: 0.1 | 1.950 | 0.78 | Example |
| 7 | 0.02 | 3.2 | 0.08 | 0.002 | 0.001 | 0.001 | 0.004 | 0.002 | Mo: 0.05 | 1.960 | 0.78 | Example |
| 8 | 0.03 | 3.5 | 0.05 | 0.002 | 0.001 | 0.001 | 0.007 | 0.003 | Nb: 0.005 | 1.959 | 0.80 | Example |
| 9 | 0.04 | 3.3 | 0.06 | 0.002 | 0.001 | 0.001 | 0.006 | 0.001 | P: 0.08 | 1.955 | 0.79 | Example |
| 10 | 0.03 | 3.2 | 0.07 | 0.002 | 0.001 | 0.001 | 0.007 | 0.004 | P: 0.05, Sb: 0.05, Cr: 0.05, Mo: 0.02 | 1.964 | 0.77 | Example |
| 11 | 0.04 | 3.3 | 0.07 | 0.001 | 0.024 | 0.001 | 0.003 | 0.003 | — | 1.830 | 1.45 | Comparative Example |
| 12 | 0.03 | 3.4 | 0.06 | 0.021 | 0.001 | 0.011 | 0.003 | 0.003 | — | 1.802 | 1.77 | Comparative Example |
| 13 | 0.02 | 3.2 | 0.07 | 0.001 | 0.001 | 0.001 | 0.023 | 0.003 | — | 1.884 | 1.12 | Comparative Example |
| 14 | 0.03 | 3.3 | 0.09 | 0.002 | 0.001 | 0.001 | 0.003 | 0.008 | — | 1.811 | 1.62 | Comparative Example |

As is apparent from Table 5, in those cases using slabs satisfying the compositional ranges specified in the disclosure, in which the total cold rolling reduction in the final cold rolling was set to 85% or more, the rolling reduction per pass was set to 32% or more, and work rolls having a surface roughness Ra of 0.25 μm or less were used in at least one pass other than the final pass, the resulting grain-oriented electrical steel sheets exhibited good magnetic properties.

The invention claimed is:

1. A method for manufacturing a grain-oriented electrical steel sheet, the method comprising:

heating a steel slab having a composition that contains, in mass %, C: 0.08% or less, Si: 4.5% or less, and Mn: 0.5% or less, and that contains, in mass ppm, S: less than 50 ppm, Se: less than 50 ppm, O: less than 50 ppm, N: less than 60 ppm, and sol.A1: less than 100 ppm, and the balance consisting of Fe and incidental impurities;

subjecting the steel slab to hot rolling to obtain a hot rolled sheet;

optionally subjecting the hot rolled sheet to hot band annealing;

subjecting the hot rolled sheet to cold rolling either once, or twice or more with intermediate annealing performed therebetween, to thereby obtain a cold rolled sheet having a final thickness;

subjecting the cold rolled sheet to decarburization annealing to obtain a decarburization annealed sheet;

applying an annealing separator mainly composed of MgO on a surface of the decarburization annealed sheet; and then subjecting the decarburization annealed sheet to secondary recrystallization annealing, wherein the cold rolling comprises final cold rolling with a total cold rolling reduction being set to 85% or more and a rolling reduction per pass being set to 32% or more, wherein the final cold rolling includes one or more passes followed by a final pass and uses work rolls having a mean surface roughness Ra of 0.25 μm or less in at least one of the one or more passes other than the final pass, and wherein the method further comprises, before initiating the final cold rolling, and after the hot rolling or the hot band annealing, heating both widthwise edges of the steel sheet to be subjected to the final cold rolling to a temperature from 100° C. to 400° C.

2. The method for manufacturing a grain-oriented electrical steel sheet according to claim 1, wherein the decarburization annealing comprises heating the cold rolled sheet from 500° C. to 700° C. at a heating rate of 50° C./s or higher.

3. The method for manufacturing a grain-oriented electrical steel sheet according to claim 1, wherein the composition further contains, in mass %, one or more selected from the group consisting of Ni: 0.01% to 1.50%, Sn: 0.03% to 0.20%, Sb: 0.01% to 0.20%, P: 0.02% to 0.20%, Cu: 0.05% to 0.50%, Cr: 0.03% to 0.50%, Mo: 0.008% to 0.50%, and Nb: 0.0010% to 0.0100%.

4. The method for manufacturing a grain-oriented electrical steel sheet according to claim 2, wherein the composition further contains, in mass %, one or more selected from the group consisting of Ni: 0.01% to 1.50%, Sn: 0.03% to 0.20%, Sb: 0.01% to 0.20%, P: 0.02% to 0.20%, Cu: 0.05% to 0.50%, Cr: 0.03% to 0.50%, Mo: 0.008% to 0.50%, and Nb: 0.0010% to 0.0100%.

5. The method for manufacturing a grain-oriented electrical steel sheet according to claim 1, wherein the rolling reduction per pass of the cold rolling is set to 60% or less.

6. The method for manufacturing a grain-oriented electrical steel sheet according to claim 1, wherein the rolling reduction per pass of the cold rolling is set to 35% or more.

* * * * *